United States Patent [19]

Sheard et al.

[11] 4,154,357

[45] May 15, 1979

[54] FIBROUS STRUCTURES

[75] Inventors: Dennis R. Sheard; Barry Walker, both of Harrogate, England

[73] Assignee: Imperial Chemical Industries Limited, London, England

[21] Appl. No.: 877,736

[22] Filed: Feb. 14, 1978

[30] Foreign Application Priority Data

Feb. 23, 1977 [GB] United Kingdom ..... 7570/77

[51] Int. Cl.[2] ..... B65D 25/00

[52] U.S. Cl. ..... 220/88 A; 156/306; 427/387; 428/288; 428/296; 428/351; 428/373; 428/391; 428/920

[58] Field of Search ..... 427/387; 428/288, 289, 428/290, 296, 297, 321, 351, 391, 451, 373, 920; 220/88 A, 88 R

[56] References Cited

U.S. PATENT DOCUMENTS

| | | | |
|---|---|---|---|
| 3,895,151 | 7/1975 | Matthews et al. | 428/288 |
| 4,068,036 | 1/1978 | Stanistreet | 428/296 |

*Primary Examiner*—James J. Bell

*Attorney, Agent, or Firm*—Cushman, Darby & Cushman

[57] ABSTRACT

A water repellent thermally bonded fibrous structure is obtained by applying a silicone based water repellent finish to potentially adhesive conjugate fibres, forming a web from the fibres, and subjecting the web to a heat treatment to effect inter-fibre bonding.

9 Claims, No Drawings

FIBROUS STRUCTURES

The present invention relates to thermally bonded fibrous structures.

It is known to produce a thermally bonded, fibrous structure by subjecting an open fibrous structure (eg a carded web or a batt) comprising crimped or crimpable, potentially adhesive, conjugate fibres to a heat treatment to effect interfibre bonding. U.S. Pat. No. 4,068,036 describes a suitable method for the production of such a fibrous structure.

By the term "potentially adhesive, conjugate fibres" is meant continuous filaments or staple fibres composed of at least two fibre-forming polymeric thermoplastic components arranged in distinct zones across the cross-section of the fibre and substantially continuous along the length thereof. One of the components has a softening temperature significantly lower than the softening temperature(s) of the other component(s) and is located so as to form at least a portion of the peripheral surface of the fibre. Types of conjugate fibres within this definition, for example, include those wherein a component of lower melting temperature is (a) one of two components arranged side-by-side, or (b) forms a sheath about another component serving as a core, or (c) forms one or more lobes of a multilobal fibre.

Thermally bonded, fibrous structures may be produced having a thickness up to 20 cm or more, and a wide range of densities, depending upon the method of production. Low density, high porosity, open "sponge-like" thermally bonded fibrous structures, such as those produced by the process described in U.S. Pat. No. 4,068,036, can be used in a large number of outlets. Unfortunately the fibrous structures suffer from the disadvantage that they readily wick water, and once water has entered the structures it is difficult to remove by normal drainage.

This deficiency of the fibrous structures may be overcome by treating them with a water repellent finish, such as those specially formulated for the treatment of fabric. However, such a treatment presents numerous difficulties due to the thickness of the structures, and their porosity. Often these problems may be overcome at the expense of modifying the properties of the structure such as, for example, the thickness and density thereof, caused by a mangling operation to expel any excess of the water repellent finish. In addition, unconventional finishing equipment may be required to handle the bulky structures.

Surprisingly, it has now been found that a water repellent finish based upon a silicone may be applied to the potentially adhesive, conjugate fibres prior to their conversion into an open web or batt, and that the finish on the fibres does not substantially affect their potentially adhesive properties. Thus, although the peripheral surface of the fibre is coated with a thin layer of a water repellent finish which modifies the surface properties of the fibres, the coating on that portion of the surface formed from the lower melting component does not prevent the lower melting component from being softened by the action of heat and adhering to a like surface, or to a surface formed from a higher melting component, also having a coating of water repellent finish.

Therefore, according to the present invention, a process for the production of a thermally bonded, non-woven fibrous structure comprises forming a fibrous structure from fibres to which a silicone based water repellent finish has been applied, at least 20% of the fibres comprising potentially adhesive conjugate fibres, (as hereinbefore defined), subjecting the fibrous structure to a heat treatment to effect inter-fibre bonding, and then causing or permitting the bonded fibrous structure to cool.

Preferably the fibrous structure comprises at least 50% of conjugate fibres, and desirably is formed entirely of conjugate fibres. To facilitate the production of a bonded structure of low density, the fibres may be crimped and heat set prior to their conversion into the fibrous structure. However, the process is equally suitable for bonding structures comprising potentially crimpable fibres, that is, fibres which develop crimp when subjected to a heat treatment.

Silicone based water repellent finishes which may be applied to the fibres may be any of the well known types suitable for treating fabrics. Those based upon cross-linkable silicones are particularly suitable. The finish may be applied to the fibres at any convenient stage. Thus, the finish may be applied to the fibres immediately after spinning, during the drawing stage, if one is used, or by spraying the finish onto the fibres before conversion into an open fibrous structure. The finish is conveniently applied as an emulsion, especially an aqueous emulsion, and may contain various additives such as, for example, catalysts to promote cross-linking of the finish, emulsifiers to help form an emulsion and to stabilise the emulsion once formed, and an anti-static agent to help in the production of the open fibrous structure, for example, by carding staple fibres. Desirably, the additives are selected from those which do not decrease the water repellent properties of the emulsion, or which, if unstable on heating to the temperature required to thermally bond the fibres, break down into compounds which do not affect the water repellent properties.

The products of the present invention have been found to be particularly suitable for surrounding fuel tanks, especially fuel tanks of vehicles and aircraft, to suppress the propagation of flames arising from an explosion occuring within the fuel tank. Thus, any void between an aircraft fuel tank and the surrounding structure of the aircraft is filled with, for example, blocks of fibrous structure produced according to the process of the present invention. Because the fibrous structure is water repellent, any water which may be in that part of the aircraft adjacent to the fuel tank is not wicked up by the fibrous structure, thereby accelerating corrosion of the aircraft structure.

The invention will be further described with reference to the following examples.

EXAMPLE 1

During the production of drawn conjugate staple fibres using a conventional drawframe an aqueous emulsion comprising 4% by weight of Emulsion 75, a polysiloxane, and an organometallic salt, Catalyst 62, (6:1 ratio), ex Dow Corning Ltd, was applied to the fibre tow after drawing by passing the tow through a bath of the emulsion at room temperature. Excess liquor was squeezed from the tow which was subsequently crimped, heat set and cut. The staple fibres comprised 100% sheath/core conjugate fibres of nominal decitex 12 having a core of polyethylene terephthalate (M Pt 252° C.) and a sheath of a copolymer of polyethylene terephthalate and polyethylene isophthalate (80:20 mole ratio) of M Pt 206° C. The ratio of core to sheath was 2:1 by weight. The fibre was carded, laid in the form of a random web and passed through a bonding oven in which hot air at 235° C. was passed through the web during a residence time of 4 minutes. Good interfibre bonding occurred within the web.

COMPARATIVE EXAMPLE A

A random web comprising conjugate fibres of the type used in Example 1 but without the application of the silicone emulsion was also passed through the bonding oven under identical conditions. The degree of interfibre bonding which occurred in this web was substantially the same as in the web comprising silicone treated fibres.

A comparative test to evaluate the efficiency of water drainage from the structures was carried out as follows:

Rectangular pieces 10 cm×10 cm×3.3 cm were cut from the bonded webs and these were weighed. The pieces were then immersed in water and squeezed under water so that the interstices of the webs were completely filled with water. They were then lifted out and held so that they drained from corner to corner. When drainage ceased the samples were weighed and the weight of water retained was determined. This is expressed in the table below as a multiple of the weight of the dry piece. The sample in which the fibres had received the silicone treatment had a significantly lower retention of water after drainage as above.

EXAMPLE 2

The process of Example 1 was repeated except that the silicone emulsion applied to the tow comprised three components available from Dow Corning Ltd: DC167, a 35% emulsion of a hydroxy terminated dimethyl polysiloxane, XT4-0149 a methyl trimethoxysilane and Q2-7059 a 40% active emulsion of dibutyl tin dithioisobutyl acetate. Some acetic acid is also included to hydrolyse the T4-0149. The concentrated emulsion was diluted to 5% concentration by weight.

The carded web bonded well during passage through the hot air oven having an air temperature of 235° C. and employing a residence time of 4 minutes. Drainage tests according to the method described above were carried out, and the mean value for water retention is given in the table below. The water retention is significantly lower than the sample comprising fibres having no silicone treatment.

| Treatment Of Fibre In Sample | Number Of Times Own Weight Of Water Retained |
|---|---|
| Example 1 | 2.4 |
| Example 2 | 1.3 |
| Comparative Example A | 6.6 |

EXAMPLE 3

The silicone emulsion described in Example 2 was applied to a tow of conjugate fibres, the fibres, each of 14 decitex, having a core of nylon-66 and a sheath of nylon-6, and a sheath: core ratio of 1:1. The tow was then stuffer box crimped and cut to give staple fibres using conventional methods. A random web obtained by carding the fibres and layering the thus obtained carded sheet of fibres, was thermally bonded by subjecting it to steam having a temperature of 230° C. for 2 minutes. Water drainage tests, as described above, showed that the water retention of the thermally bonded, non-woven fibrous structure was only 1.5 times the weight of the bonded structure, a value considerably less than that for a similar structure produced from nylon heterofil fibres free from the silicone emulsion.

We claim:

1. A process for the production of a water repellent, thermally bonded, non-woven, fibrous structure comprising the steps of (a) forming a fibrous structure from fibers formed from the group of polymers consisting of polyesters and polyamides, and to which a silicone based water repellent finish, has been applied, at least 20% of the fibers comprising potentially adhesive conjugate fibers, (b) subjecting the fibrous structure to a heat treatment to effect inter-fiber bonding, and (c) causing or permitting the bonded fibrous structure to cool.

2. A process according to claim 1 wherein at least 50% of the fibers forming the fibrous structure comprise potentially adhesive conjugate fibers.

3. A process according to claim 1 wherein the fibrous structure is formed entirely of potentially adhesive fibers.

4. A process according to claim 1 wherein the fibrous structure of step (a) is formed from crimped or potentially crimpable fibers.

5. A process for the production of a water repellent, thermally bonded, non-woven, fibrous structure comprising the steps of (a) forming a fibrous structure from fibers to which a cross-linkable, silicone based, water repellent finish has been applied, at least 20% of the fibers comprising potentially adhesive conjugate fibers, (b) subjecting the fibrous structure to a heat treatment to effect inter-fibre bonding, and (c) causing or permitting the bonded fibrous structure to cool.

6. A water repellent, thermally bonded, non-woven, fibrous structure made by the process of claim 1.

7. A water repellent, thermally bonded, non-woven, fibrous structure made by the process of claim 5.

8. A fuel tank having an external flame suppression means contiguous therewith comprising a water repellent, thermally bonded, non-woven, fibrous structure produced by the steps of (a) forming a fibrous structure from fibers to which a silicone based water repellent finish has been applied, at least 20% of the fibers comprising potentially adhesive conjugate fibers, (b) subjecting the fibrous structure to a heat treatment to effect inter-fiber bonding, and (c) causing or permitting the bonded fibrous structure to cool.

9. In a process for producing a thermally bonded, non-woven, fibrous structure, comprising the steps of:

(a) forming a fibrous structure from fibers formed from the group of polymers consisting of polyesters and polyamides, at least 20% of the fibers comprising potentially adhesive conjugate fibers, (b) subjecting the fibrous structure to a heat treatment to effect inter-fiber bonding; and (c) causing or permitting the bonded fibrous structure to cool, the improvement of providing a water repellant fibrous structure comprising applying to the fibers prior to heat treating step (b) a silicone-based water repellant finish.

* * * * *